US007793910B2

(12) United States Patent
Salman

(10) Patent No.: US 7,793,910 B2
(45) Date of Patent: Sep. 14, 2010

(54) SURFACE-MOUNTED POST BASE

(76) Inventor: Mark T. Salman, 3502 Meadowbriar Ct., Greensboro, NC (US) 27410

( * ) Notice: Subject to any disclaimer, the term of this patent is extended or adjusted under 35 U.S.C. 154(b) by 129 days.

(21) Appl. No.: 11/812,590

(22) Filed: Jun. 20, 2007

(65) Prior Publication Data

US 2008/0315062 A1 Dec. 25, 2008

(51) Int. Cl.
*F16M 13/00* (2006.01)

(52) U.S. Cl. ..... 248/519; 248/520; 40/607.1

(58) Field of Classification Search ..... 248/519, 248/520, 523, 346.03; 40/606.01, 607.1; 52/297

See application file for complete search history.

(56) References Cited

U.S. PATENT DOCUMENTS 3,902,818 A * 9/1975 Boone ..... 404/10
4,079,559 A * 3/1978 Tenbrummeler ..... 52/295
4,596,489 A * 6/1986 Mariol et al. ..... 404/10
6,422,783 B1 7/2002 Jordan
6,457,895 B1 10/2002 Salman
6,616,369 B2 * 9/2003 Clark ..... 404/10
6,712,330 B1 * 3/2004 Damiano ..... 248/519
6,739,567 B1 5/2004 Curtis
7,195,222 B2 3/2007 Dent
7,614,601 B2 * 11/2009 Marsilio et al. ..... 248/551
2003/0233793 A1 12/2003 Burkart et al.

* cited by examiner

*Primary Examiner*—A. Joseph Wujciak, III
(74) *Attorney, Agent, or Firm*—Richard C. Litman

(57) ABSTRACT

A surface-mounted base for a breakaway signpost. The base is configured as a sphere so as to present no edges that may be impacted by a vehicle and includes a sunken socket ensuring that no metal shards project above grade after a post is damaged. The base is provided with recessed slots for retaining securing bolts therein. This arrangement prevents the securing bolt heads from being contacted by the undercarriage of a vehicle or mower and plow blades of maintenance machines. The slots also allow for rotation of the base during installation ensuring correct orientation of the signpost. Reflective or florescent materials can be attached to the recesses to enhance night visibility.

4 Claims, 7 Drawing Sheets

SURFACE-MOUNTED POST BASE

BACKGROUND OF THE INVENTION

1. Field of the Invention

The present invention generally relates to support structure. More specifically, the present invention is drawn to a support member for a breakaway post assembly.

2. Description of the Related Art

The ubiquitous signpost appears to be a permanent fixture in modern societies. The signposts are employed to support traffic signals, traffic warnings, location designations, advertisement, general information, etc. It is conventional to install the base of the signpost in concrete. Unfortunately many of these signposts must be positioned in "harms way", that is, in a position where an errant vehicle can crash into the signpost, causing damage to the vehicle and signpost and possible fatal injury to the vehicle occupants and nearby pedestrians.

The breakaway signpost has played an important role in mitigating damage and injury in the above-described scenario. In many instances, however, installing the base of these posts in concrete poses a difficult challenge. Standard installation in concrete requires the use of relative expensive tools such as diamond core drills, rock drills, post-driving machines, etc. to create an opening in the concrete for insertion of the base of the signpost. Furthermore, there are many instances where standard installation procedures cannot be used. Sites having utilities located just below the surface and structures wherein drilling might damage structural integrity prevent the use of standard installation procedures. Surface-mounted signpost bases have alleviated these problems to a degree. However, the current crop of surface-mounted bases creates a different set of problems. For example, (1) the bases have exposed edges and can be easily torn away from the mounting surface when the undercarriage of a vehicle impacts an edge; (2) the vehicles undercarriage can catch the heads of the base securing bolts thereby damaging the undercarriage, dislodging the base from the surface and exposing the pin and socket post support that projects above the base; (3) in many cases the impact leaves the damaged the pin and socket projecting above grade posing a further risk to vehicles and pedestrians; (4) difficulties are encountered when installing the bases on uneven surfaces. Therefore, the art would certainly welcome a breakaway post-mounting system that would alleviate the problems discussed above. Thus, a surface-mounted, breakaway post solving the aforementioned problems is desired.

Applicant's patent (U.S. Pat. No. 6,457,895 B1), along with other pertinent related art cited and identified in the accompanying IDS, are examples of current breakaway post and surface-mounted post technology. However, none of the above cited and identified related art, taken either singly or in combination, is seen to disclose a breakaway post surface-mounting system as will be subsequently described and claimed in the instant invention.

SUMMARY OF THE INVENTION

The present invention is a surface-mounted base for a breakaway signpost. The base is configured as a hemisphere so as to present no edges that may be impacted by a vehicle and includes a sunken socket ensuring that no metal shards project above grade after a post is damaged. The base is provided with recessed, radial slots for retaining securing bolts therein. This arrangement prevents the securing bolt heads from being contacted by the undercarriage of a vehicle or mower and plow blades of maintenance machines. The slots also allow for rotation of the base during installation, ensuring correct orientation of the signpost. Reflective or florescent materials can be attached to the recesses to enhance night visibility.

Accordingly, the instant invention presents a surface-mounted base for breakaway signposts, which base is safe and reliable despite the angle of impact. The base configuration ensures that the attachment fasteners play no role in the breakaway feature. The invention provides for improved elements thereof in an arrangement for the purposes described that are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
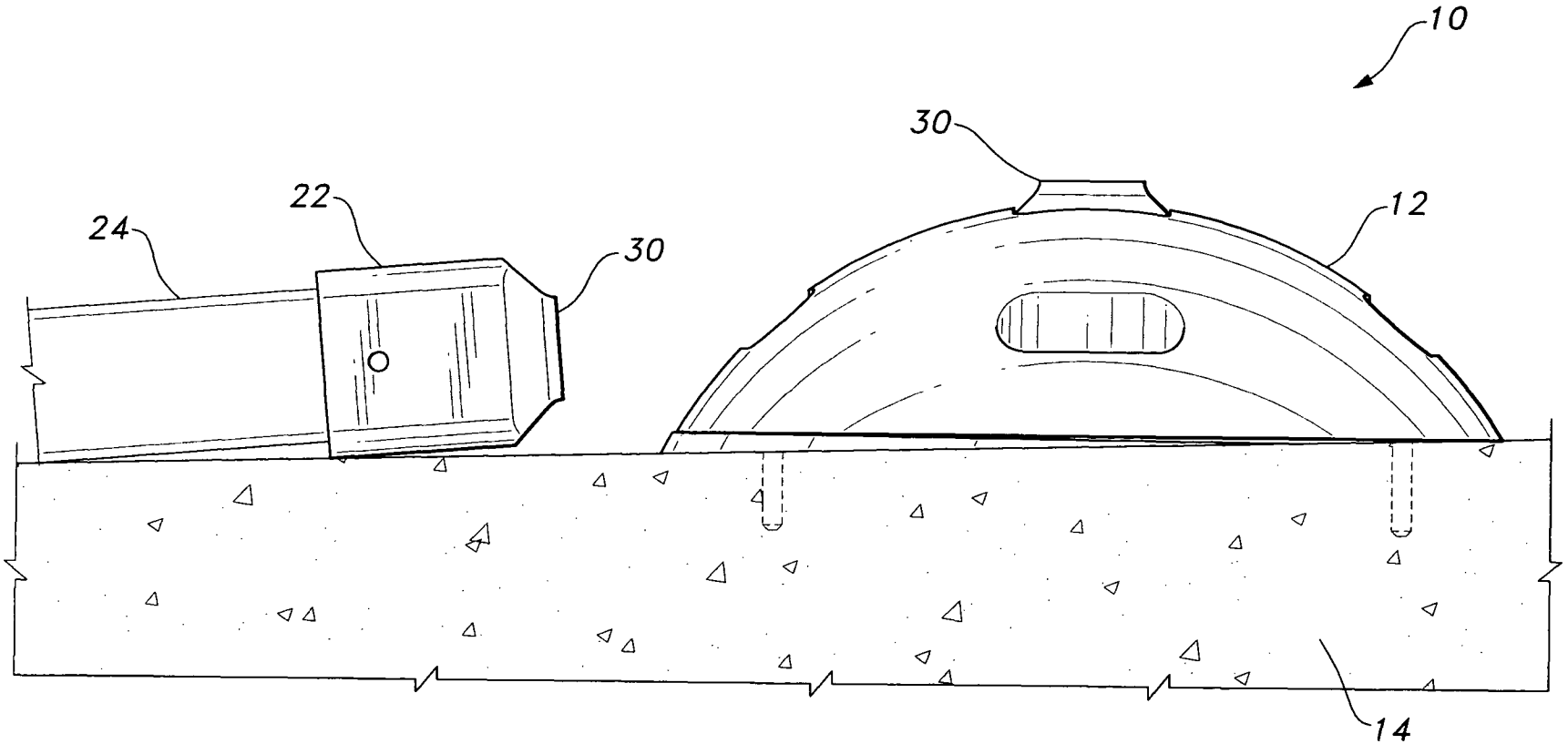
FIG. 1 is an environmental view of a surface-mount base for a breakaway post according to the present invention.
Figure 2:
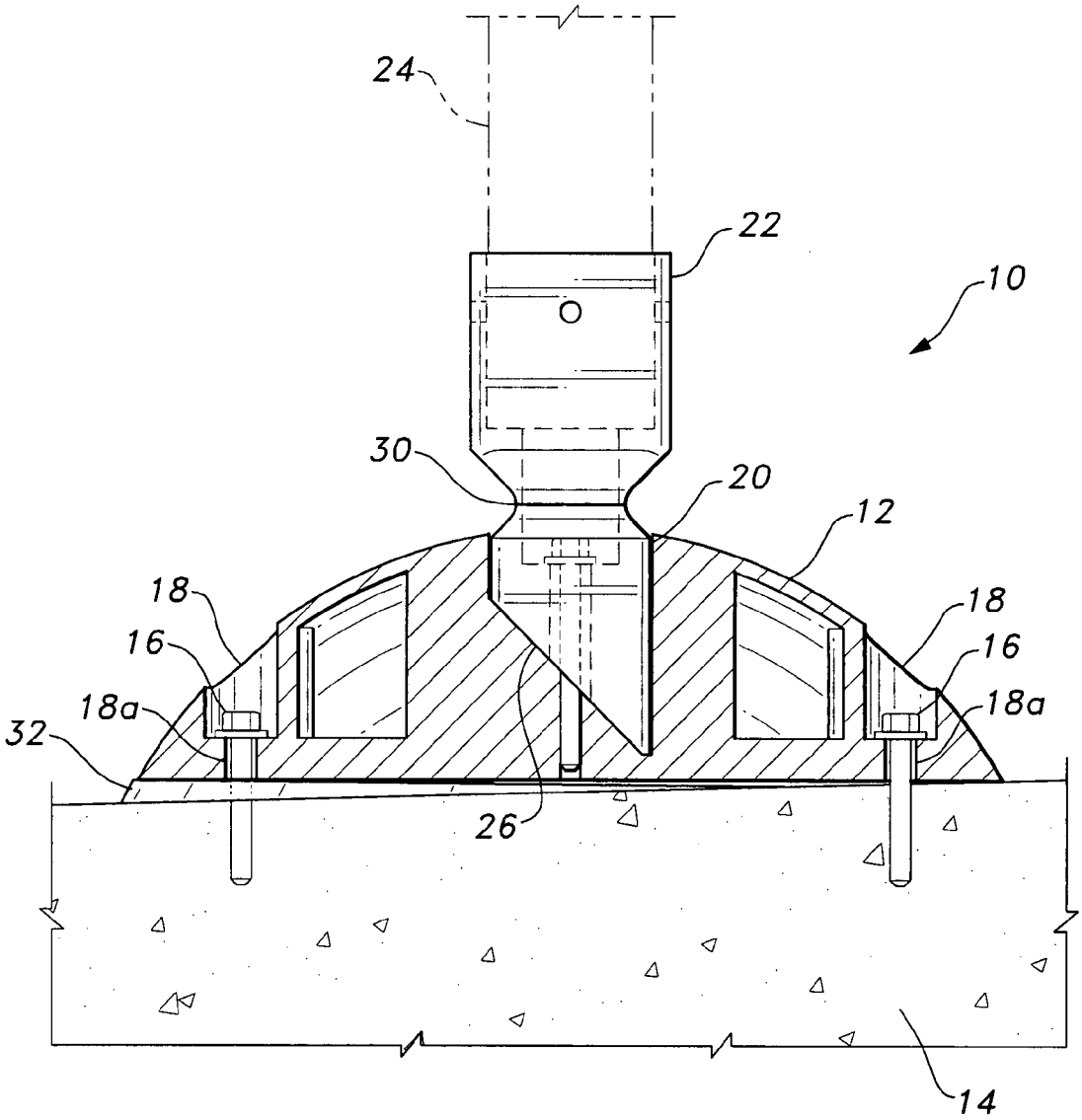
FIG. 2 is a sectional view of a first embodiment of a surface-mount base for a breakaway post according to the present invention.

Attention is first directed to FIGS. 1 and 2 wherein the surface-mounted base of the present invention is generally indicated at 10. Surface-mounted base 10 comprises a member 12 of hemispherical configuration having a planar bottom surface mounted on the upper surface of a concrete substrate 14. Plural bolts 16 are employed to secure member 12 to substrate 14. Recesses 18 are evenly spaced around the perimeter of member 12 to house bolts 16 therein. The bolts are received through radial slots 18*a* formed in the bottom surface of member 12. A central socket 20, formed in member 12, houses the breakaway base 22 of signpost 24 therein. The instant embodiment incorporates a socket having a sloped bottom wall 26 that abuts a complimentary surface on base 22 and includes a shear section 30 in the manner as disclosed in Applicant's patent U.S. Pat. No. 6,457,895 B1. If impacted by a vehicle or the like at a pre-determined force, the base 22 is designed to break away or shear at point 30 as illustrated in FIG. 1. Because of its hemispherical configuration, impact forces caused by vehicle undercarriages, vehicle wheels or mower blades will not create pulling forces that would dislodge member 12 from substrate 14. The bolts 16, housed in recesses 18, avoid direct impact and will also avoid pulling forces created by the impacting vehicle. A multi-directional shim 32 is employed to level member 12 on sloped surfaces. Plural shims can be used if necessary.

Figure 3:
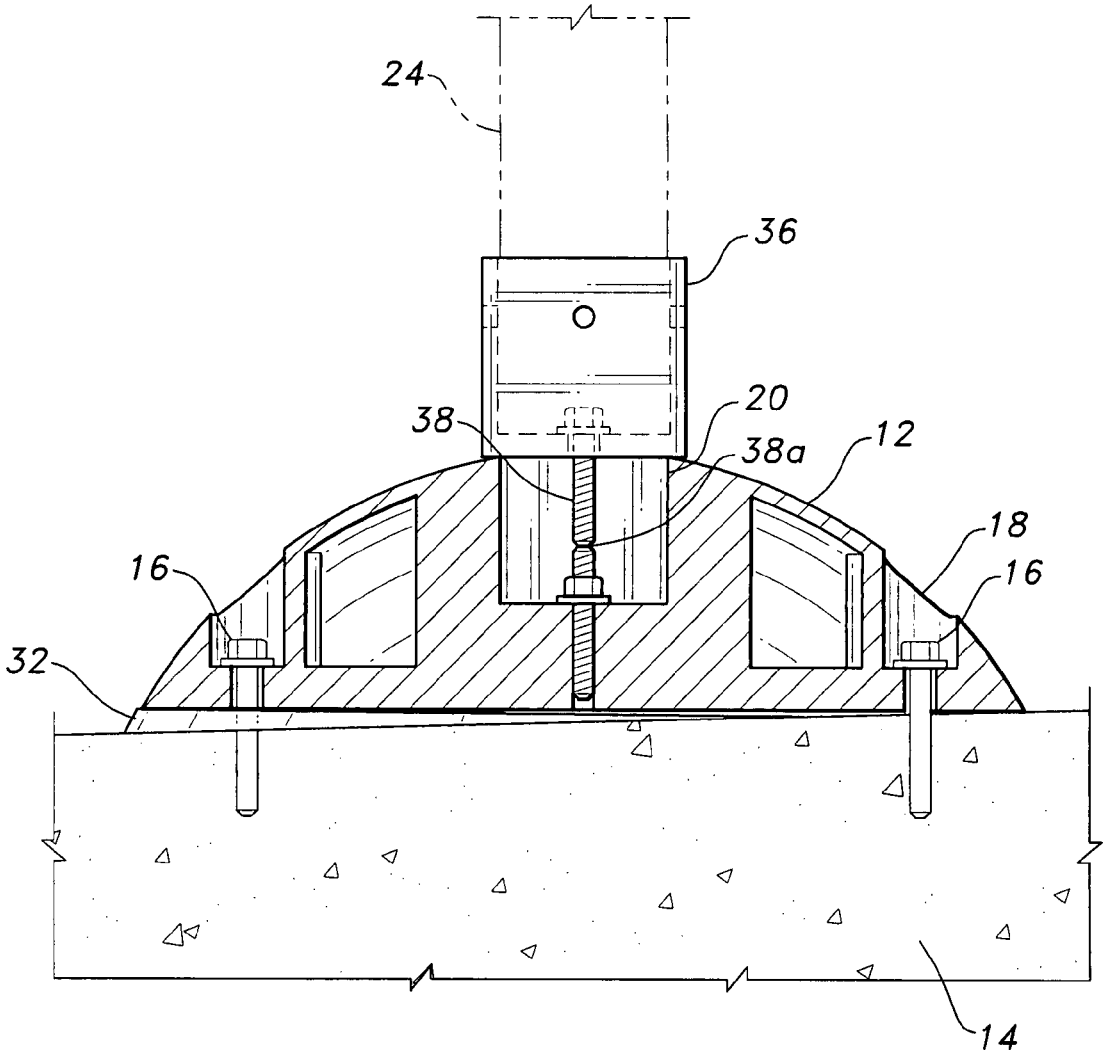
FIG. 3 is a sectional view of a second embodiment of a surface-mount base for a breakaway post according to the present invention.

FIG. 3 illustrates an embodiment of the invention that includes a flange 36 housing the lower end of signpost 24 therein. Flange 36 is secured in socket 20 by means of a breakable bolt 38, which bolt is provided with a breakaway point at 38*a*. Bolt 38 is mounted to the horizontal bottom wall of socket 20.

Figure 4:
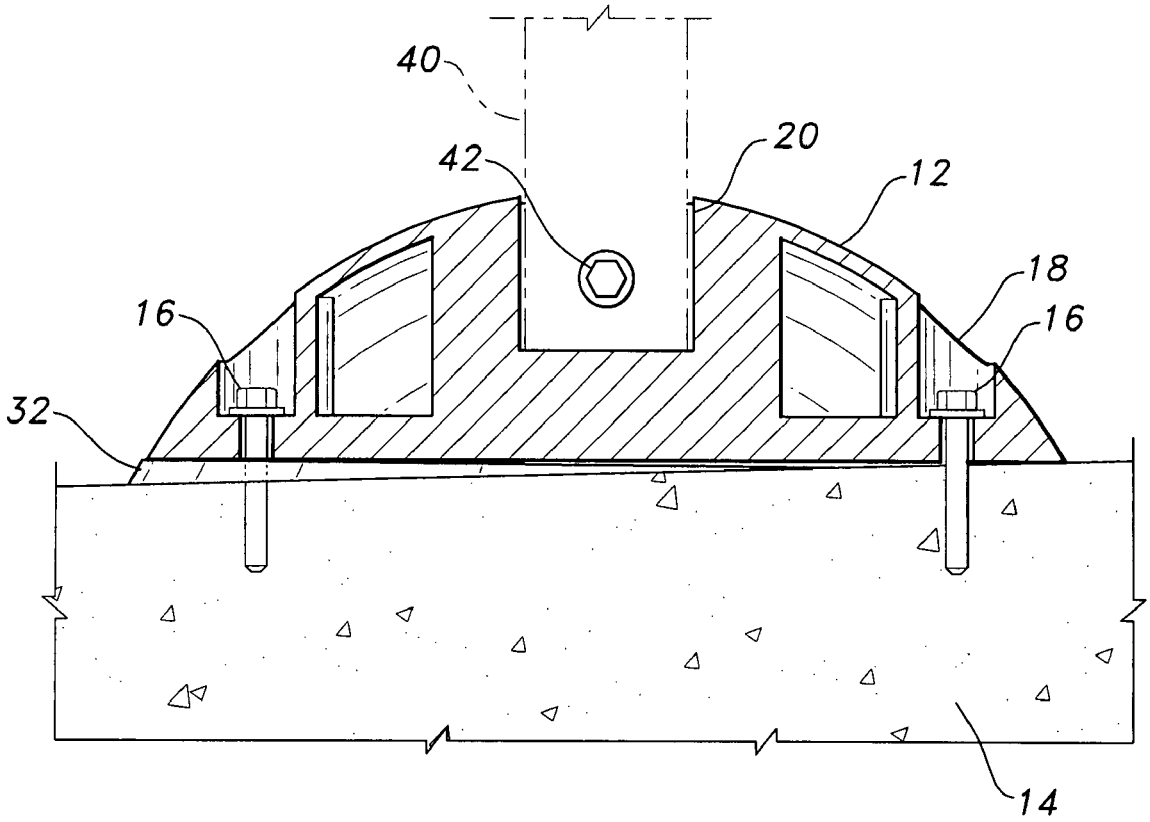
FIG. 4 is a sectional view of a third embodiment of a surface-mount base for a breakaway post according to the present invention.

The embodiment illustrated in FIG. 4 is illustrative of an arrangement of surface mounting that does not require a breakaway feature such as when the posts are installed inside a building. In the instant embodiment socket 20 is configured to retain the base 40 of a standard square, round or U-shaped post. Set screws 42 (only one is shown) are utilized to secure the post base 40 in the socket.

Figure 5:
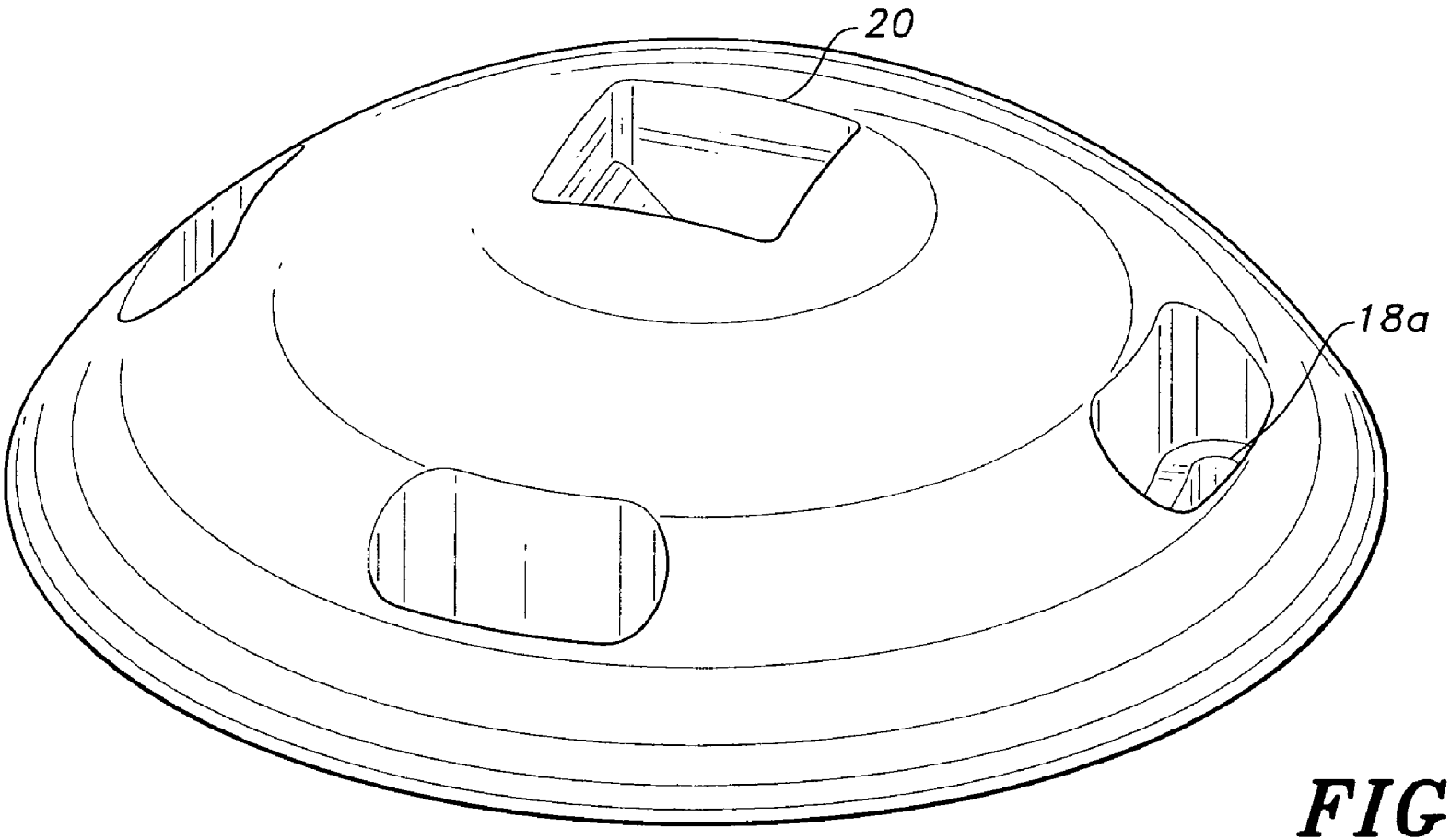
FIG. 5 is a perspective view of a hemispherical base of a surface-mount base for a breakaway post according to the present invention.
Figure 6:
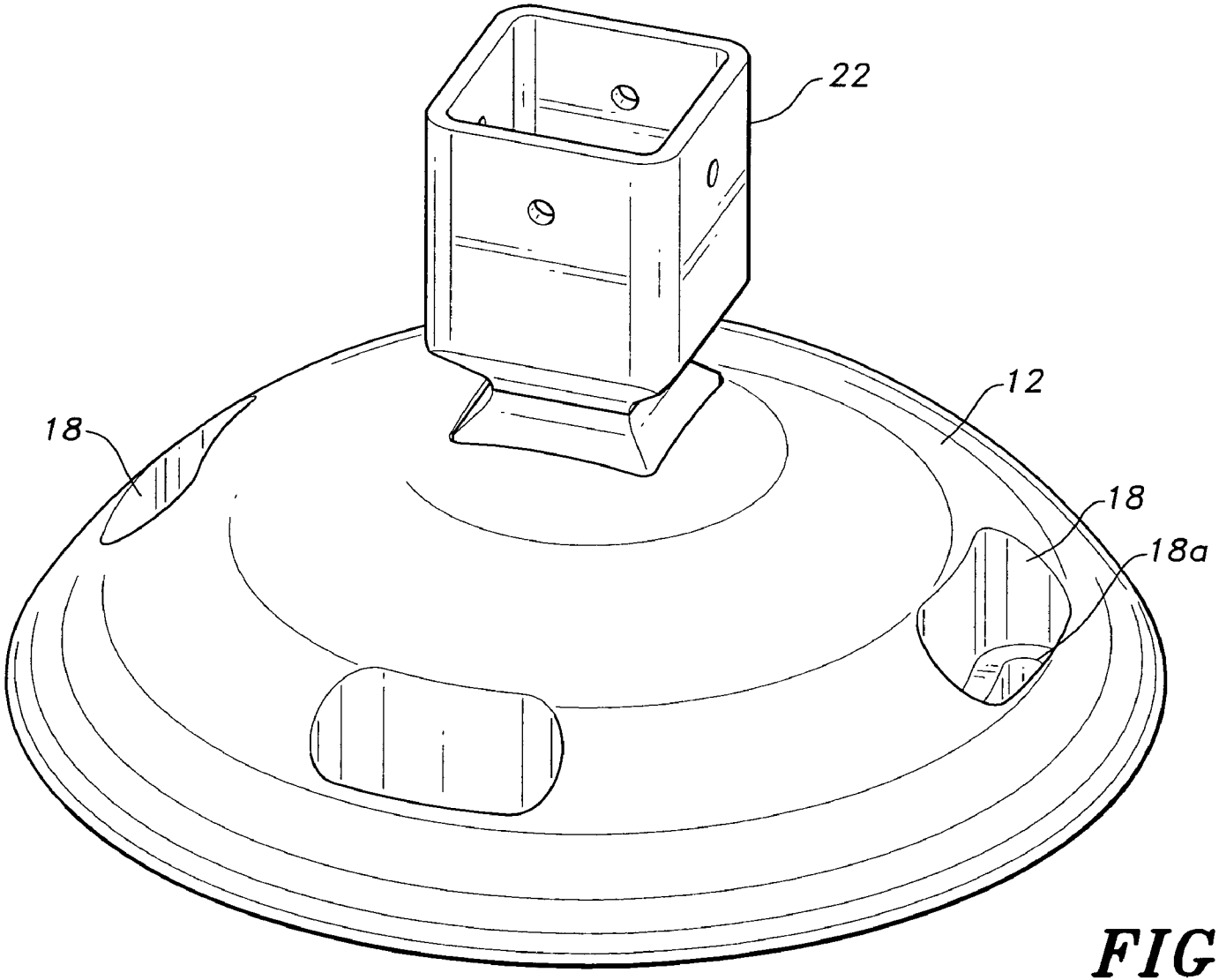
FIG. 6 is a perspective view of a hemispherical base and signpost support of a surface-mount base for a breakaway post according to the present invention.
Figure 7:
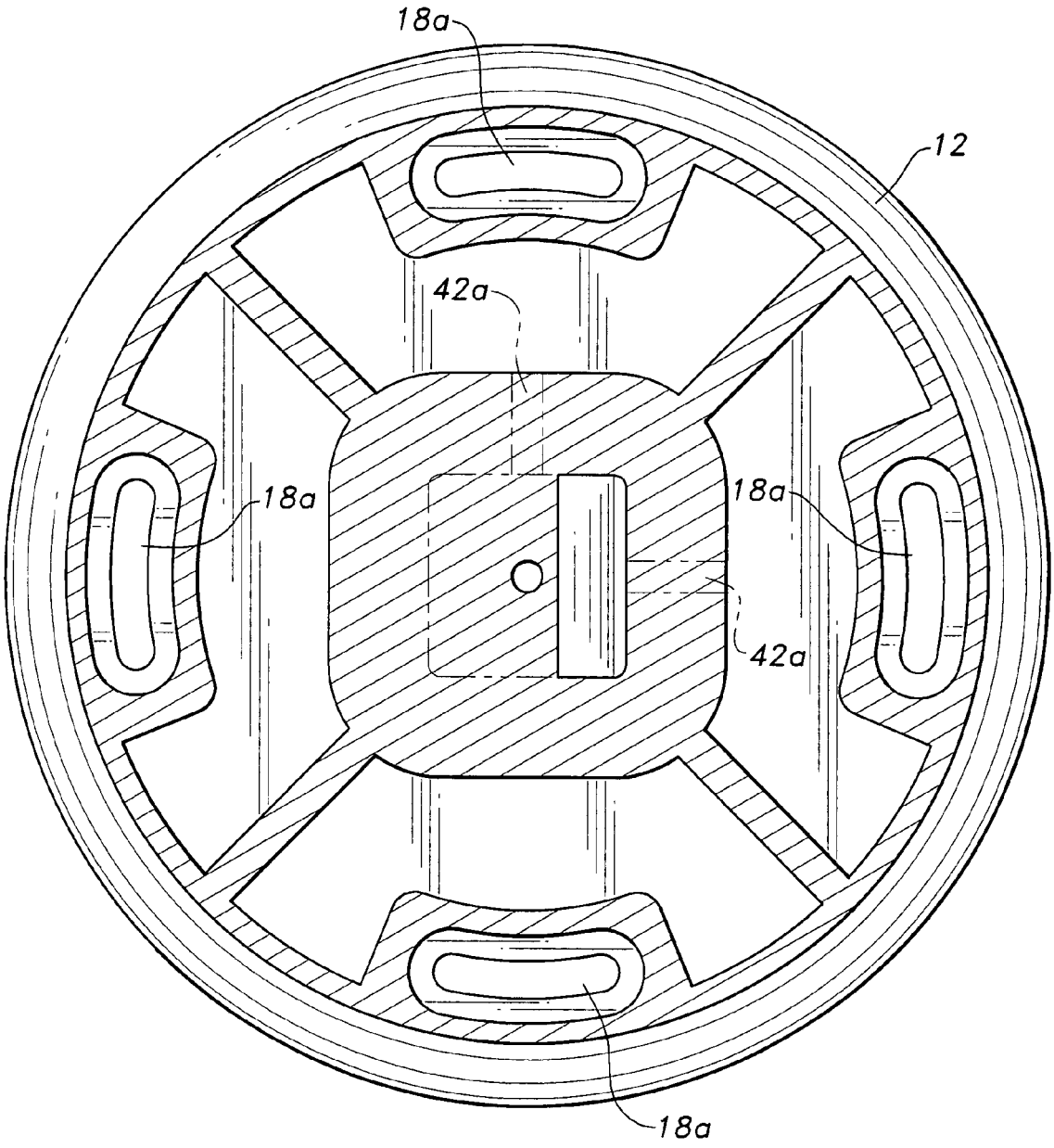
FIG. 7 is a sectioned, top view of a variant of a hemispherical base of a surface-mount base for a breakaway post according to the present invention.

FIGS. 5-7 show details of hemispherical member 12 more clearly. As noted above, each recess 18 is provided with a radial slot 18*a*, which slot extends through the bottom surface of member 12. The radial slots allow for rotation of member 12 for adjustment and proper signpost orientation before bolts 16 are tightened. The variant disclosed in FIG. 7 shows passages 42*a* for receiving set screws 40.

It is to be understood that the present invention is not limited to the embodiments described above, but encompasses any and all embodiments within the scope of the following claims.

I claim:

1. A surface-mounted base, for a breakaway signpost comprising:

a base member configured as a hemisphere, said base member having a planar bottom surface, a curved upper surface and a perimeter;

an opening forming a socket disposed in a central area of said curved upper surface;

a bottom wall having a solid surface, disposed in said socket, said bottom wall having a continuously sloping planar surface, wherein a bottom surface of the signpost does not extend beyond the surface of the bottom wall;

breakaway structure for supporting the signpost disposed in said opening forming a socket;

a plurality of recesses spaced around said perimeter;

an array of slots formed through said planar bottom surface; and a respective bolt disposed in each slot of said array.

2. The surface-mounted base for a signpost according to claim 1, wherein each bolt of said plurality of bolts is received in a respective slot of said array of slots.

3. The surface-mounted base for a signpost according to claim 1, wherein each slot of said array of slots is disposed in a respective recess of said plurality of recesses.

4. The surface-mounted base for a signpost according to claim 3, wherein each slot of said array of slots is a radial slot.

* * * * *